US006880927B2

(12) United States Patent
Stork et al.

(10) Patent No.: US 6,880,927 B2
(45) Date of Patent: Apr. 19, 2005

(54) PRINTING MEDIUM FOR THE INKJET PRINTING METHOD

(75) Inventors: Gerhard Stork, Flensburg (DE); Makato Kato, Flensburg (DE); Karsten Lerius, Munkbrarup (DE)

(73) Assignee: Mitsubishi HiTec Paper Flensburg GmbH, Flensburg (DE)

( * ) Notice: Subject to any disclaimer, the term of this patent is extended or adjusted under 35 U.S.C. 154(b) by 22 days.

(21) Appl. No.: 10/415,689

(22) PCT Filed: Oct. 19, 2001

(86) PCT No.: PCT/EP01/12116

§ 371 (c)(1),
(2), (4) Date: May 1, 2003

(87) PCT Pub. No.: WO02/36354

PCT Pub. Date: May 10, 2002

(65) Prior Publication Data

US 2004/0027433 A1 Feb. 12, 2004

(30) Foreign Application Priority Data

Nov. 1, 2000 (DE) ..... 100 54 219

(51) Int. Cl.[7] ..... B41J 2/01
(52) U.S. Cl. ..... 347/105; 347/101
(58) Field of Search ..... 347/105, 101, 347/100; 428/195, 32.1; 106/31.6, 31.13; 523/160

(56) References Cited

U.S. PATENT DOCUMENTS 5,075,153 A * 12/1991 Malhotra ..... 347/105
5,180,624 A 1/1993 Kojima et al.
5,958,579 A * 9/1999 Idei et al. ..... 428/32.22
6,110,601 A * 8/2000 Shaw-Klein et al. ..... 347/106
6,562,441 B1 * 5/2003 Maeda et al. ..... 428/32.34

FOREIGN PATENT DOCUMENTS

| | | | | |
|---|---|---|---|---|
| DE | 196 44 014 | | 5/1998 | |
| EP | 0 602 326 | A1 | 6/1994 | |
| EP | 0 914 962 | A2 | 5/1999 | |
| EP | 914962 | A * | 5/1999 | ..... B41M/5/00 |
| EP | 0 947 350 | A1 | 10/1999 | |
| EP | 947350 | A1 * | 10/1999 | ..... B41M/5/00 |
| EP | 1 029 703 | A1 | 8/2000 | |
| EP | 1 033 259 | A2 | 9/2000 | |
| JP | 06-092012 | | 4/1994 | |
| JP | 09240139 | | 9/1997 | |
| JP | 10152544 | | 6/1998 | |
| JP | 11277887 | | 10/1999 | |
| JP | 11277888 | | 10/1999 | |

* cited by examiner

*Primary Examiner*—Manish Shah
(74) *Attorney, Agent, or Firm*—Cohen, Pontani, Lieberman & Pavane

(57) ABSTRACT

A printing medium for the inkjet printing method having a substrate and an ink acceptor layer, which is applied to at least one side of the substrate, wherein the ink acceptor layer includes an ink fixing agent and an inorganic pigment. The ink fixing agent includes a medium molecular weight branched amine-epichlorohydrin condensate which includes at least 70% by weight of the total quantity of the ink fixing agent in the ink accepting layer, the inorganic pigment is present at least 80% by weight with a particle size in a range between 6 and 12 $\mu$m and the ink fixing agent to pigment ratio is in a range from 1:2 to 1:6.

7 Claims, No Drawings

PRINTING MEDIUM FOR THE INKJET PRINTING METHOD

PRIORITY DATA

The present application is a National Phase of PCT Application No. PCT/EP01/12116, filed on Oct. 19, 2001. Priority is claimed to that application and to German Application No. 100 54 219.0, filed in Germany on Nov. 1, 2000.

BACKGROUND OF THE INVENTION

1. Field of the Invention

The invention relates to a recording material for the inkjet printing method, including a substrate and an ink-accepting layer which is applied to at least one side of the substrate, the ink-accepting layer containing an amine-epichlorohydrin condensate and an inorganic pigment. The invention furthermore relates to a process for recording by the discontinuous inkjet printing method, which process uses the inventive recording material.

2. Description of the Related Art

Reaction products prepared on the basis of amine compounds and epihalohydrins are known as assistants for the ink-accepting layers of inkjet recording materials.

For improving the water-insensitivity of printed images which are produced by means of inkjet printers and are intended to be distinguished by outstanding print quality, for example, JP-A-11 277 888 proposes an assistant comprising a linear cationic resin which is formed as the reaction product of an amine component containing a secondary amine with another amine component containing at least two amino groups and an epihalohydrin.

JP-A-11 277 887 likewise relates to an assistant which increases the water resistance and has a different structural formula of the linear cationic resin compared with the document discussed above and a comparable effect which, however, according to the text of the description, is extended to include the reduction of the so-called "ink bleeding" in the case of printed images produced by means of ink-jet printers. In both documents discussed above, the viscosity of the 20% strength aqueous solution containing in each case the proposed assistant is stated as from 50 to 500 mPa·s (B types; 30° C.).

The object of JP-A-10 162 544 is to provide an inkjet recording paper which, in the case of printed images produced using aqueous inks, permits only slight "ink bleeding" and moreover enables a high ink concentration and outstanding water resistance of the printed images. The object is to be achieved by an addition to the coating material in the form of a branched cationic resin which is present as the reaction product of ammonia with at least one preferably primary, secondary or tertiary amine and an epihalohydrin. Furthermore, polyalkylenepolyamine and alkanolamine are preferred as the amine. The viscosity of the 10% strength aqueous solution of this cationic resin is from 1 to 30 mPa·s, measured according to Brookfield (60 rpm/25° C.).

With the aim of presenting a production process for inkjet recording papers on which the ink droplets of aqueous inks bleed only slightly and on which printed images having high ink density and outstanding water resistance are permitted, JP-A-09 240 139 proposes the application of a branched cationic resin which is formed as the reaction product of a polyalkylenepolyamine with an epihalohydrin and, if required, furthermore with an aliphatic amine component. The viscosity of a 10% strength aqueous solution containing the proposed cationic resin is stated as 30 mPa·s, measured according to Brookfield (60 rpm/25° C.).

The teaching of the documents discussed above is that the cationic resins to be used as assistants should suitably be selected in medium molecular weight linear or low molecular weight branched form. On the other hand, these documents provide no information either about possible ratios of the cationic resins to pigments present in the ink-accepting layers or about particular properties of these pigments which are to be established.

According to EP-A-0 914 962, the outstanding inkjet recording property and the superior offset printability of recording material are to be achieved by means of its particularly well bound surface, which moreover has high water resistance. According to the statements of this document, the object is achieved by a linear cationic resin in the ink-accepting layer, inter alia dimethylamine-epichlorohydrin polycondensates being mentioned as examples of this cationic resin. In addition to the cationic resin, the ink-accepting layer furthermore contains binders and optionally pigments. The document gives no information about advantageous properties of the pigments in the ink-accepting layer. Furthermore, this document discloses no advantageous ratios of the cationic resin to other components of the ink-accepting layer.

Finally, EP-A-0 602 326 discloses a quaternary salt of a linear dimethylamine-epichlorohydrin adduct having a degree of polymerization of from 2 to 2 000 as a low molecular weight ink fixing agent in the recording layer of an ink-jet recording paper. In combination with a (meth) acrylamide-diallylamine copolymer, color deviations in applied printed images are to be avoided, in addition to an increase in the ink fixability.

If used at all in the recording layers disclosed there, suitable inorganic and organic pigments are those whose particle size is in a range below 4 $\mu$m.

For a long time, pigment-based recording inks were scarcely used instead of inks based on organic dyes, in particular on acidic azo dyes. The problem with this type of recording ink is the low light stability of the organic dyes, associated with the problem of printed images which fade and become discolored, which could be solved to date only unsatisfactorily by means of UV absorbers in the recording inks and by means of ink stabilizers in the inkjet recording materials.

The pigment-based recording inks now more frequently used are substantially more light-stable than the inks discussed above and based on organic dyes, but the pigment-based recording inks have the problem of "ink bleeding", which is to be understood as meaning the running of different colored printed patterns directly adjacent to one another into one another directly after the printing process. The recording material according to the invention has been developed for use with pigment-based recording inks and significantly reduces the problem of "ink bleeding".

In inkjet printing, a distinction is made in principle between two different methods of droplet production.

The continuous method provides an ink jet which is ejected under pressure from a nozzle and, owing to the surface tension, separates into very small droplets a certain distance away from the nozzle. The droplets are electrically charged and, depending on the printed image to be produced, are then either deflected into a collecting container or positioned on the recording material by the electric field of electronically controlled deflection plates.

In the discontinuous, so-called "drop-on-demand" method, the ink droplets are produced and ejected from a nozzle, depending on the printed image to be produced, only when an image dot is to be produced on the recording material. One type of "drop-on-demand" printers uses the piezoelectric effect in which an electrically controlled piezoelectric element separates an ink droplet from the reservoir of the recording ink and ejects this droplet from a nozzle. In contrast, "bubble jet" printers use an electrically controlled heating element which allows very small amounts of an aqueous ink to form in a vapor bubble. The resulting vapor pressure ejects the droplet.

The invention relates to recording materials which can be used in both discontinuous methods.

SUMMARY OF THE INVENTION

It is an object of the present invention to provide a recording material for the inkjet printing method, which recording material is cost-efficient from economic points of view and is particularly suitable for being printed on with pigment-based recording inks in the discontinuous, i.e., drop-on-demand, method. In particular, the inventive recording material should guarantee outstanding fixing of the applied inks and thus reduce the so-called "ink bleeding". With the tailoring of the novel recording material to pigmented inks, it is intended to permit high light stability of the applied printed images.

Since pigmented inks are preferably used in poster printing and the posters thus produced such as, for example, billboards are exposed to direct sunlight, a novel recording material which is distinguished by high stability to any tendency to yellowing is preferably to be provided. Finally, the recording material should ensure acceptable wet smudge resistance of applied printed images.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

After intensive laboratory and production tests, the inventors recognized that the object is achieved by a recording material for the inkjet printing method, comprising a substrate and an ink-accepting layer which is applied to at least one side of the substrate, the ink-accepting layer containing an amine-epichlorohydrin condensate and a pigment, characterized in that

- the ink-accepting layer contains at least one ink fixing agent which comprises a medium molecular weight branched amine-epichlorohydrin condensate,
- the amine-epichlorohydrin condensate constitutes at least 70% by weight of the total quantity of the ink fixing agent in the ink-accepting layer,
- the pigment is an inorganic pigment, at least 80% by weight of the inorganic pigment present has a particle size in a range from 6 to 12 $\mu$m,
- the pigment portion comprises between 30 and 70% by weight of the ink-accepting layer, and
- the ink fixing agent/pigment ratio of the ink-accepting layer is in a range from 1:2 to 1:6.

In the context of this invention, the amine-epichlorohydrin condensate has a medium molecular weight, if it has a viscosity in a range from 20 mPa·s to 50 mPa·s as a 10% strength aqueous solution. The above-mentioned viscosity is determined according to Brookfield (spindle 1/100 rpm/25° C.).

The invention is based on the choice of the amine-epichlorohydrin condensate as at least one ink fixing agent which is optionally incorporated together with other ink fixing agents into the ink-accepting layer. It is essential to the invention that the amine-epichlorohydrin condensate be present in medium molecular weight branched form. Other embodiments of the amine-epichlorohydrin condensate prove to be unsuitable for various reasons; thus, for example, it is not possible to use a low molecular weight straight-chain amine-epichlorohydrin condensate because recording materials containing such a condensate develop too strong an odor owing to the free amine.

It is possible for the ink-accepting layer to contain exclusively a medium molecular weight branched amine-epichlorohydrin condensate as the ink fixing agent. On the basis of the discoveries of this invention, the simultaneous use of further ink fixing agents in addition to the medium molecular weight branched amine-epichlorohydrin condensate is also possible, and—without being restricted thereto—one or more of the following compounds selected from polydiallyldimethylammonium chloride, cationic polyacrylamide, cationic polyacrylates, polyvinylamines, polyethylenimine and polydicyanodiamides are present in an amount which does not exceed 30% by weight, in particular 10% by weight, based on the total amount of the ink fixing agent.

The inventors furthermore recognized that the ink fixing agent/pigment ratio in the ink-accepting layer must be in a range from 1:2 to 1:6, based on the percentages by weight of pigment and ink fixing agent in the ink-accepting layer, the percentages by weight being based on all ink fixing agents and pigments incorporated into the ink-accepting layer.

Completely surprising for the inventors was the fact that, however, the object of the invention can be completely and convincingly achieved only when, simultaneously with the above-mentioned features, the pigment is an inorganic pigment and at least 80% by weight of the inorganic pigment present have a particle size in a range from 6 to 12 $\mu$m, determined as the D50 value (Malvern—i.e. the determination is effected according to the data of the pigment manufacturers using a laser measuring apparatus from Malvern, Master-Sizer S type). Furthermore, the pigment portion of the ink-accepting material must, according to the invention, be in a range between 30 and 70% by weight.

It is to the inventors' credit to have recognized that it is only the above features in combination which permit a recording material which has this large number of required properties.

In comparative investigations, it was found that, with the use of polydiallyldimethylammonium chloride (poly-DADMAC) as an ink fixing agent, the "ink bleeding" behavior is significantly poorer. The use of polyethylenimine or polydicyanodiamides is not possible because the recording materials which contain these cationic polymers have a greater tendency to yellowing.

The ink fixing agent/pigment ratio of from 1:2 to 1:6 according to the invention is limited firstly by a more sharply decreasing wet smudge resistance (with larger amounts of ink fixing agent beyond an ink fixing agent/pigment ratio of 1:2, the wet smudge resistance is no longer acceptable), and, on the other hand, by increasingly poor "ink bleeding" behavior (with smaller amounts of ink fixing agent beyond an ink fixing agent/pigment ratio of 1:6, the "ink bleeding" has to be rejected as being no longer convincing).

On the basis of the results of the test series on which this invention is based, the inventors recognized that particularly good properties of the inventive recording material are present if the ink fixing agent/pigment ratio is in a range from 1:3 inclusive to 1:5.5 inclusive, based on the percentages by weight of pigment and ink fixing agent in the ink-accepting layer, the percentages by weight once again being based on all ink fixing agents and pigments incorporated into the ink-accepting layer.

The ink-accepting layer of the recording material according to the invention comprises an amount of binder and cobinder in a range from 10 to 55% by weight. Aqueous polymer dispersions of ethylene-vinyl acetate and in particular styrene-butadiene latex, polyacrylates and solutions of partially or completely hydrolyzed polyvinyl alcohol, which are used alone or in combination, have proven particularly useful.

Aluminum hydroxide and silica gel and precipitated silica have proven particularly useful as inorganic pigments. The three last-mentioned pigments may each be modified with aluminum or with alumina or may be present in unmodified form.

It has proven advantageous if the total content of ink fixing agent in the ink-accepting layer is in a range from 5 to 30% by weight, preferably in a range from 5 to 20% by weight, there being a tendency to choose this total amount toward the lower limit when applying ink-accepting layers having a high mass per unit area within the above range. Further components, such as, for example, sodium hydroxide solution, optical brighteners and antifoams, without being restricted thereto, are to be added as necessary and account for up to 5% by weight of the ink-accepting layer, the individual amounts in the ink-accepting layer summing to 100% by weight.

In order convincingly to meet the range of requirements, the mass per unit area of the ink-accepting layer should not be chosen to be too low since otherwise the wet smudge resistance decreases too sharply and, likewise, the "ink bleeding" can be reduced to an insufficient extent. The upper limit of the mass per unit area of the ink-accepting layer is determined primarily by economic factors.

In numerous experiments, it was found to be advantageous to form the ink-accepting layer in two strata positioned one on top of the other, a lower stratum being in contact with the substrate or with a preparation layer applied to the substrate while an upper stratum is applied to the lower stratum. Particularly good results can be obtained if the first strata has a mass per unit area of from 4 to 12 g/m$^2$, preferably from 6 to 8 g/m$^2$, and the second stratum has a mass per unit area of from 2 to 10 g/m$^2$, preferably from 4 to 6 g/m$^2$. For the two strata, the same teachings with regard to the inventive choice of components and the ratio of these components to one another are in principle applicable, in particular in their preferred embodiments. The two strata also have the same auxiliary components according to the disclosures of this document.

If the ink-accepting layer is formed only as a single stratum, a mass per unit area of this layer of from 4 to 15 g/m$^2$ is advisable, a range of from 5 to 10 g/m$^2$ being particularly preferred and a range of from 7 to 9 g/m$^2$ being very particularly preferred.

It is preferable if at least one preparation layer which has a mass per unit area preferably in a range from 0.1 to 2.0 g/m$^2$ is arranged between the substrate and the single stratum or, in a preferred embodiment, the first stratum of the ink-accepting layer. The preparation layer may be in the form of a simple starch coat.

In a particularly preferred embodiment, the recording material according to the invention comprises, on the side which is opposite the side with the ink-accepting layer, a backing coating which may be in the form of an ink-accepting layer but also in the form of a simple starch coat. Particularly as a starch coat, it serves for ensuring a good grip, so that there is no fear of transport difficulties in the inkjet printers. Furthermore, improved printability, in particular in the offset printing process, can be achieved with the aid of a simple starch coat. The starch coat in the form of a backing coating preferably has a mass per unit area in a range from 0.1 to 2.0 g/m$^2$.

It is particularly preferable if the substrate is a paper web.

The invention furthermore relates to a process for recording by the discontinuous inkjet printing method using a pigment-based recording ink and using a recording material. The recording material comprises a substrate and an ink-accepting layer which is applied to at least one side of the substrate, the ink-accepting layer containing an amine-epichlorohydrin condensate and a pigment and

- the ink-accepting layer containing at least one ink fixing agent which comprises a medium molecular weight branched amine-epichlorohydrin condensate,
- the amine-epichlorohydrin condensate constitutes at least 70% by weight of the total quantity of the ink fixing agent in the ink-accepting layer,
- the pigment is an inorganic pigment, at least 80% by weight of the inorganic pigment present have a particle size in a range from 6 to 12 $\mu$m,
- the pigment portion of the ink-accepting layer is between 30 and 70% by weight, and
- the ink fixing agent/pigment ratio of the ink-accepting layer being in a range from 1:2 to 1:6.

The invention also relates to a process for recording by the discontinuous inkjet printing method using a pigment-based recording ink and using a recording material according to the invention which may be in the form of one of the embodiments described further above.

The novel process envisages printing on the novel recording material using "drop-on-demand" printers which use either the piezoelectric effect or, as "bubble jet" printers, use an electrically controlled heating element for ejecting very small ink droplets.

The data on mass per unit area, on % by weight and on parts by weight which are stated in the description and patent claims relate, unless expressly noted otherwise, in each case to the absdry weight, i.e. absolutely dry parts by weight. The abbreviation "adry" stands for air-dry and, where used, means that the components thus designated are described in their commercial delivery form.

The following examples and comparative examples will illustrate the invention further:

Production of a substrate:

A paper web comprising bleached and beaten hardwood and softwood pulps with the addition of customary additives in customary amounts, having a mass per unit area of 82 g/m$^2$, is produced as a substrate on a Foudrinier paper machine. The paper web receives a starch preparation of 0.3 g/m$^2$ on the front, and a starch preparation of 1 g/m$^2$ is applied to the back.

Basic formulation for the preparation of coating slips for an ink-accepting layer for examples 3, 7, and 11 according to the invention and for comparative examples 1, 2, 4, 5, 6, 8, 9, 10, and 12:

The following components are introduced into a container, based on 500 parts by weight (adry) altogether, with constant stirring:

| Component | % amount (absdry) | Solids content [%] | % amount (adry) |
|---|---|---|---|
| Water | — | — | 278.7 |
| Sodium hydroxide solution [10% strength] | 0.3 | 10 | 3.0 |
| Pigment | 58.9 | 100 | 58.9 |
| Optical brightener | 2.9 | 50 | 5.8 |
| Mixture of binder (PVAl*[1], completely hydrolyzed) and cobinder (EVAC*[2]) | 24.8 | 20 | 126.6 |
| Ink fixing agent | 13.0 | 50 | 28.0 |
| Antifoam | 0.1 | 10 | 1.0 |
| Total | 100 | 20 | 500 |

*[1]Polyvinyl alcohol
*[2]Ethylene-vinyl acetate

.

The pigment used was silica gel not modified with aluminum and having a pore volume of 1.2 ml/g with the following average particle sizes and specific internal surface areas:

| | Pigment 1 | Pigment 2 | Pigment 3 |
|---|---|---|---|
| Particle size [$\mu$m] | 6.5 | 8 | 10 |
| Specific internal surface area [$m^2/g$] | 390 | 290 | 390 |

.

The examples in each case provide an amine-epichlorohydrin condensate as an ink fixing agent, with the following distinction:

Ink fixing agent A: low molecular weight, straight-chain (12 mPa·s)

Ink fixing agent B: medium molecular weight, straight-chain (36.5 mPa·s)

Ink fixing agent C: medium molecular weight, branched (35 mPa·s)

Ink fixing agent D: high molecular weight, straight-chain (91 mPa·s).

The numbers in brackets in the above list of ink fixing agents give the viscosity of the amine-epichlorohydrin condensate as a 10% strength aqueous solution, measured according to Brookfield (spindle 1/100 rpm/25° C.).

EXAMPLES AND COMPARATIVE EXAMPLES 12 samples of different recording materials for the inkjet printing method were produced.

For this purpose, 12 different coating slips according to the above basic formulation were prepared, each of the three pigments 1, 2 and 3 introduced being combined with each of the ink fixing agents A, B, C and D. For the formation of the ink-accepting layers, the coating slips are applied to the paper web whose production is described above.

Once again, an inkjet printer, HP-DesignJet 2500 CP type, from Hewlett Packard (printing mode: standard without ink adaptation, printer driver: coated paper, heavy) is used for investigating the "ink bleeding" behavior, with the use of UV inks from the same manufacturer. For this purpose, in each case a test print is applied to the 12 samples and the "ink bleeding" behavior of the samples is visually assessed.

In table 1, the examples according to the invention are denoted by "IE" and comparative examples by "CE". The determined mean values and assessments are evident from table 1:

TABLE 1

| Example | Pigment | Ink fixing agent | Viscosity of the coating slip [Brookfield (spindle 2/50 rpm/25° C.)] | Mass per unit area of the ink-accepting layer [$g/m^2$] | "Ink bleeding" behavior |
|---|---|---|---|---|---|
| 1 CE | 1 | A | >800 | 8.8 | satisfactory |
| 2 CE | 1 | B | 352 | 8.9 | poor |
| 3 IE | 1 | C | 380 | 8.7 | good |
| 4 CE | 1 | D | 728 | 8.6 | poor |
| 5 CE | 2 | A | >800 | 8.9 | good |
| 6 CE | 2 | B | 240 | 8.7 | poor |
| 7 IE | 2 | C | 208 | 8.4 | good |
| 8 CE | 2 | D | 520 | 8.7 | poor |
| 9 CE | 3 | A | >800 | 8.8 | good |
| 10 CE | 3 | B | 268 | 8.6 | very poor |
| 11 IE | 3 | C | 288 | 8.8 | satisfactory |
| 12 CE | 3 | D | 580 | 8.8 | poor |

.

Starting from the basic formulation and the ink-accepting layer components according to example 7, the ink-fixing agent/pigment ratio was varied. The samples thus prepared are to be investigated with respect to their "ink bleeding" behavior and the wet smudge resistance of applied printed images.

For investigating this wet smudge resistance, the printed images for which the "ink bleeding" behavior of the samples was assessed beforehand are sprinkled with water. After a contact time of 2 seconds, a finger is wiped several times with constant pressure over the printed image. The printed image should be smudged as little as possible, ideally not at all.

For comparative example 13 and example 14 according to the invention, in order to reduce the amount of ink fixing agent, based on 500 parts by weight (adry) of basic formulation, a smaller amount of ink fixing agent and hence a larger amount of all other components are introduced into a container with constant stirring. For example 15 according to the invention and comparative example 16, in order to increase the amount of ink fixing agent, based on 500 parts by weight (adry) of basic formulation, a larger amount of ink fixing agent and hence a smaller amount of all other components are introduced into a container with constant stirring.

The subsequent preparation of the samples and the respective application of a test print are effected according to the above statements.

Table 2 shows the ink fixing agent/pigment ratios established and the respective visually assessed "ink bleeding" behavior of the samples and the wet smudge resistance of the applied printed images. Once again, examples according to the invention are denoted by "IE" and comparative examples by "CE":

TABLE 2

| Example | Ink fixing agent/pigment ratios | "Ink bleeding" behavior | Wet smudge resistance |
|---|---|---|---|
| 13 CE | 1:10 | poor | very good |
| 14 IE | 1:5 | good | Good |
| 7 IE (also see table 1) | 1:4.53 | good | Good |
| 15 IE | 1:3.3 | good | Satisfactory |
| 16 CE | 1:1.5 | good | Poor |

.

The examples according to the invention show particularly clearly that the recording material according to the invention convincingly provides an economical recording material for the inkjet printing method, which recording material, particularly in the case of printing with pigment-based recording inks, guarantees outstanding fixing of the applied inks and thus reduces the so-called "ink bleeding", which is not the case in the comparative examples. The examples according to the invention furthermore show that the inventive recording material ensures an acceptable wet smudge resistance of applied printed images, which the comparative examples are not capable of doing.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A recording material for the inkjet printing method, comprising:

a substrate having at least one side for receiving an image, and an ink accepting layer applied to said at least one side of said substrate, said ink accepting layer including an ink fixing agent and a pigment, wherein said ink fixing agent includes a medium molecular weight branched amine-epichlorohydrin condensate which comprises at least 70% by weight of the total quantity of the ink fixing agent in said ink-accepting layer, said pigment comprises an inorganic pigment, at least 80% by weight of said inorganic pigment has a particle size in a range including 6 to 12 $\mu$m, said pigment comprises between 30% and 70% by weight of said ink accepting layer, and an ink fixing agent/pigment ratio in said ink-accepting layer is in a range including 1:2 to 1:6.

2. The recording material of claim 1, wherein said pigment comprises a mixture including a plurality of inorganic pigments.

3. The recording material of claim 1, wherein said ink fixing agent/pigment ratio is in a range including 1:3 to 1:5.5.

4. The recording material of claim 1, wherein a mass per unit area of said ink-accepting layer is within a range including 4 to 15 g/m$^2$.

5. The recording material of claim 1, wherein a mass per unit area of said ink-accepting layer is within a range including 7 to 9 g/m$^2$.

6. The recording material of claim 1, further comprising at least one intermediate layer arranged between said substrate and said ink-accepting layer.

7. A process for recording an image on a recording material comprising the step of using a discontinuous inkjet printing method for recording an image on the recording material, wherein the recording material comprises:

a substrate having at least one side for receiving an image, and an ink accepting layer applied to the at least one side of the substrate, the ink accepting layer including an ink fixing agent and a pigment, wherein the ink fixing agent includes a medium molecular weight branched amine-epichlorohydrin condensate which comprises at least 70% by weight of the total quantity of the ink fixing agent in the ink-accepting layer, the pigment comprises an inorganic pigment, at least 80% by weight of the inorganic pigment has a particle size in a range including 6 to 12 $\mu$m, the pigment comprises between 30% and 70% by weight of the ink accepting layer, and the ink-accepting layer includes an ink fixing agent/pigment ratio within a range including 1:2 to 1:6.

* * * * *